United States Patent [19]

Coes, Jr.

[11] 3,986,303

[45] Oct. 19, 1976

[54] RADIALLY ADJUSTABLE GRINDING WHEEL FOR GRINDING CONCAVE SURFACES TO CONSTANT PRIMARY AND SECONDARY RADII

[75] Inventor: Loring Coes, Jr., Princeton, Mass.

[73] Assignee: Norton Company, Worcester, Mass.

[22] Filed: May 15, 1975

[21] Appl. No.: 577,726

Related U.S. Application Data

[62] Division of Ser. No. 446,468, Feb. 27, 1974, Pat. No. 3,916,572.

[52] U.S. Cl. ..... 51/206.4; 51/309 R

[51] Int. Cl.[2] ..... B24D 5/06; B24D 3/08

[58] Field of Search ..... 51/330, 331, 350, 351, 51/206 R, 206.4, 206.5, 207, 352, 355, 295, 309; 125/11 R

[56] References Cited

UNITED STATES PATENTS

| | | | |
|---|---|---|---|
| 2,348,132 | 5/1944 | Hyland | 51/351 |
| 2,627,707 | 2/1953 | Brooks | 51/351 |
| 2,746,217 | 5/1956 | Breisch | 51/351 |
| 3,375,181 | 3/1968 | Koech | 125/11 R |
| 3,573,013 | 3/1971 | Curn | 51/309 |
| 3,879,901 | 4/1975 | Caveney | 51/295 |

*Primary Examiner*—Al Lawrence Smith
*Assistant Examiner*—Nicholas P. Godici
*Attorney, Agent, or Firm*—Walter Fred

[57] ABSTRACT

A lens grinding machine with a radially adjustable work holder on which various sizes of lens carriers with lens blanks to be ground, may be mounted and moved at various predetermined radii across the peripheral abrasive surface of a radially adjustable grinding wheel rotatable in a plane normal to a plane of movement of the lens blanks. The grinding wheel has a slotted support center with flexible and resilient deformable walls supporting bonded abrasive segments containing alkali insoluble metal coated abrasive in an alkali soluble metal bond and is mounted on an arbor adapted with means to clamp the wheel and to vary the shape of the deformable walls and radius of the wheel. Wheel truing means are provided which heats and rotates the grinding wheel into forceful engagement with an adjustable rotatable truing roll to soften and form the peripheral surface of the wheel to the desired radius which is then dressed by an application of an alkali solution to remove only a sufficient amount of the metal bond to expose the peripheral abrasive elements.

7 Claims, 7 Drawing Figures

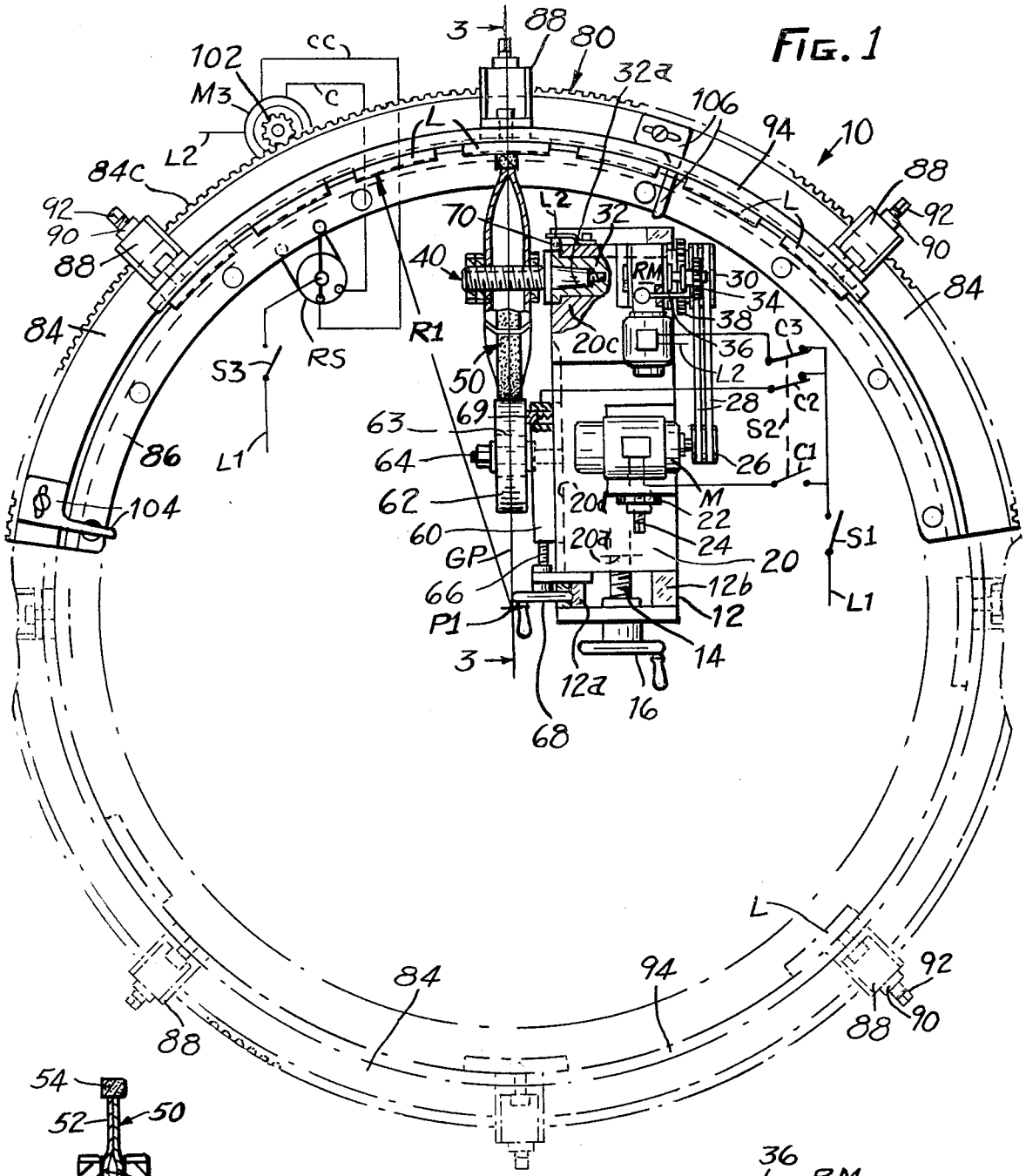
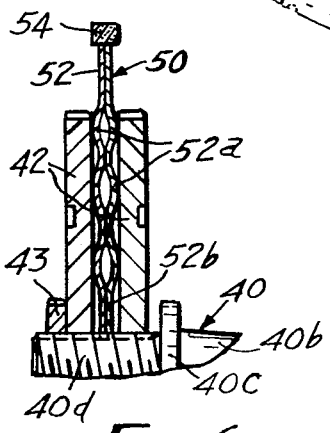
FIG. 6
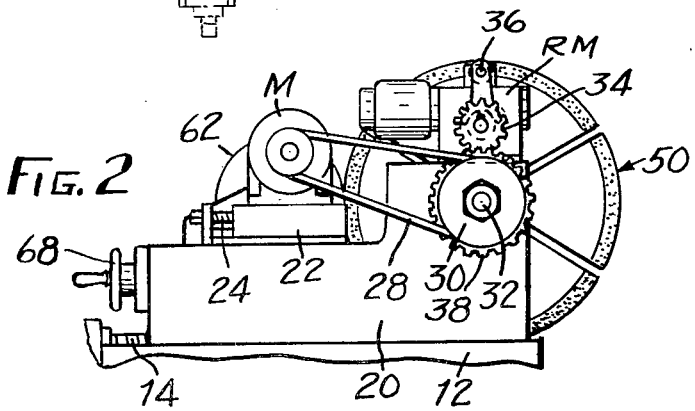
FIG. 2

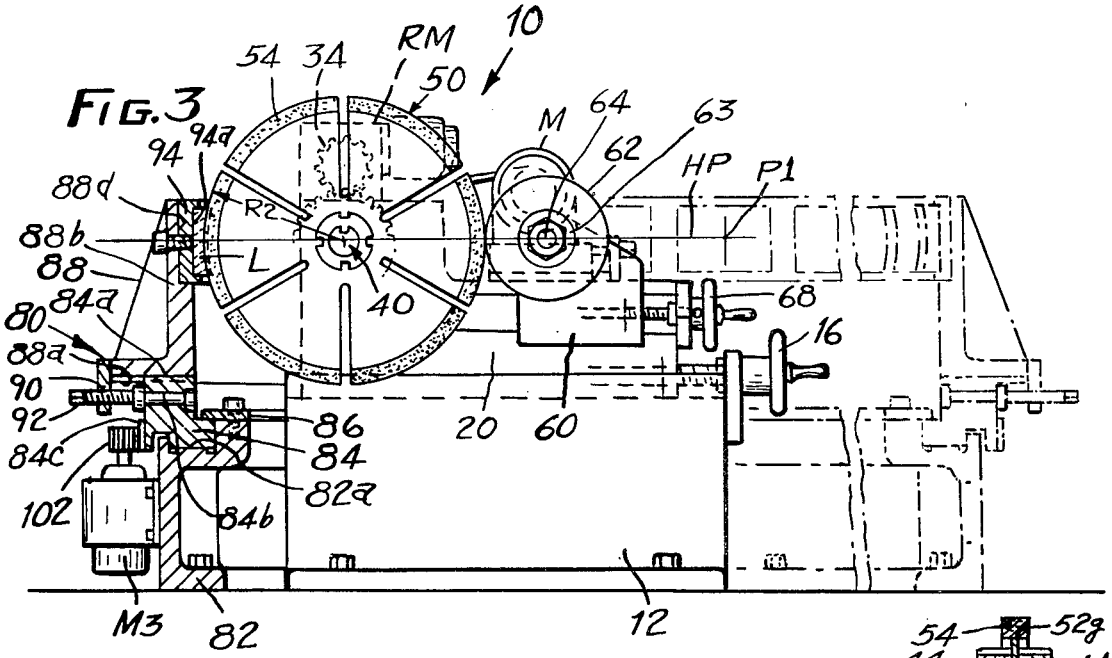
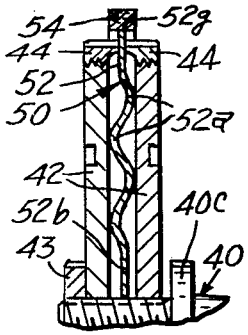
FIG. 7
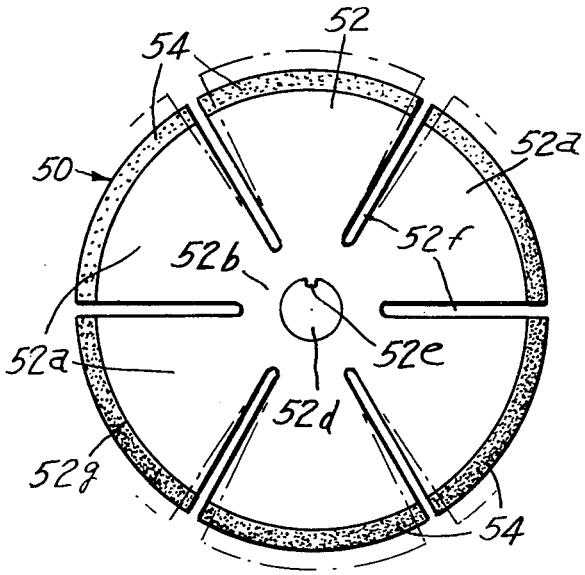
FIG. 4
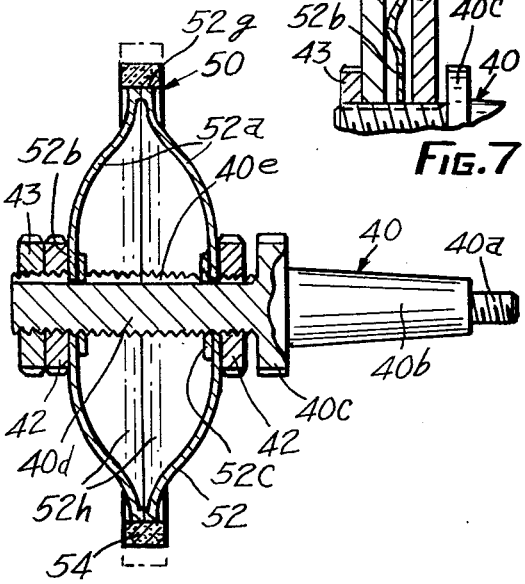
FIG. 5

RADIALLY ADJUSTABLE GRINDING WHEEL FOR GRINDING CONCAVE SURFACES TO CONSTANT PRIMARY AND SECONDARY RADII

CROSS-REFERENCE TO RELATED APPLICATIONS

This is a division of application Ser. No. 446,468, filed Feb. 27, 1974 now U.S. Pat. No. 3,916,572.

BACKGROUND OF THE INVENTION

1. Field of Invention

The invention relates to lens grinding apparatus particularly for grinding concave surfaces of toric lens blanks with infinitely variable primary and secondary radii.

2. Description of the Prior Art

It has been the practice to grind concave surfaces on lens blanks to various predetermined degrees of curvature in a manner and with apparatus similar in some respects to that disclosed by the Applicant. However, the apparatus of the prior art differs from the Applicant's in that a grinding wheel of fixed diameter rotating about a horizontal axis is adapted to be pivoted about a vertical axis and positioned at various grinding angles relative to a radial plane passing through the lenses and the vertical axis or center about which the lens blanks move concentrically across the periphery of the grinding wheel. As a result, the grinding wheel situated at an angle grinds a concave surface having an elliptical (or parabolic) shape having non-concentric curvature of constantly changing radius in one direction or plane and a concentric curvature of constant radius in another direction or plane at right angles thereto. Also, a great number of interchangeable grinding wheels of various predetermined diameters must be kept on hand to grind lens blanks to the infinite number of different curvatures required at the present time.

The Applicant's invention provides apparatus which can grind concave surfaces to many different degrees of curvature and in which the curvatures in both directions are of constant radius. Additionally, the Applicant provides a grinding wheel movable in a single plane and whose diameter can be changed to grind a large number of different curvatures of constant radius on lens blanks without pivoting the wheel and changing the rotational grinding plane of the wheel.

Applicant is aware of the various radially expandable segmental grinding wheels of the prior art disclosed in the following U.S. Pat. Nos. 2,799,979 and 2,767,523. Unlike the Applicant's wheel, they require a greater number of separate elements and precision linkage or camming mechanism to shift individual abrasive segments between clamping flanges which must be released prior to making a radial adjustment. Applicant's segmental grinding wheel has abrasive segments fixed to angularly spaced peripheral surface portions of a slotted support center with integral deformable wall portions of relatively thin flexible and resilient material between radial slots about a hub portion. The shape of each of the deformable wall portions can be simultaneously varied by axially movable clamping flanges engaging opposite sides of the support center to change the diameter and radius of the wheel.

SUMMARY OF THE INVENTION

Lens grinding apparatus for simultaneously grinding infinitely variable primary and secondary radii on the concave surfaces of a plurality of lens blanks. The apparatus comprises a fixed wheel slide base or base on which is slideably mounted an adjustable wheel slide or wheel support for supporting a radially adjustable segmental grinding wheel for rotation in a single grinding plane and about an axis of rotation to produce the secondary radius. Feed means are provided for moving the wheel along the single grinding plane relative to and toward and away from the concave surfaces of a plurality of lens blanks fixed to a lens carrier mounted on a radially adjustable work holder movable about a pivot or center situated in the grinding plane at the intersection of another plane passing through the rotational axis of the grinding wheel and at right angles to the grinding plane. The work holder is either of arcuate or circular shape extending respectively partially or completely around the grinding wheel and comprises a plurality of radially adjustable and angularly spaced lens carrier support brackets for receiving and supporting lens carriers of various curvatures or radii and lens blanks thereon at various predetermined radial distances from the pivot or center of movement.

A radially contractable and expandable segmented grinding wheel of predetermined initial diameter is mounted on an adjustable wheel mounting which is removable from and extends axially from an end portion of a wheel spindle journaled in the wheel support or slide and rotatably driven about its axis. The grinding wheel has abrasive segments attached to angularly spaced peripheral portions of a slotted support center with angularly spaced deformable wall portions of identical shape about a hub portion. The configuration of the deformable wall portions can be varied by the wheel mounting to either increase or decrease the diameter and radius of the wheel. The abrasive segments are bonded with a heat softenable and alkali soluble metal bond which aids in heating, truing and dressing the wheel to the desired secondary radius of the lens.

A wheel truing device mounted on the wheel slide comprises a truing roll rotatably mounted on a truing slide slideably mounted on the wheel slide and movable by a feed means into forceful engagement with the periphery of the abrasive segments of the grinding wheel rotatably driven at a relatively slow truing speed by auxilliary drive means. During rotatable engagement of the grinding wheels by the truing roll, an electrical current is passed between the truing roll and the wheel to heat soften the metal bond which is displaced by the truing roll to produce the desired secondary radius on the wheel and hence the lens blanks ground thereby. Thereafter, the abrasive surface is dressed by applying an alkali solution which dissolves and removes a portion of the displaced bond to expose the abrasive cutting elements. Simultaneous grinding of the primary and secondary radii on the lens blanks is accomplished by moving the carrier and lens blanks thereon at a constant radius about the pivot or center and at right angles across the peripheral abrasive surface of the grinding wheel whose radius is equal to the secondary radius and intermittently feeding the grinding wheel radially into the lens blanks to a final position equal to the primary radius from the pivot or center.

Therefore, it is the primary object of the invention to provide apparatus adaptable to grind concave surfaces to a great number of different degrees or curvature and simultaneously grind two curvature of constant radii on the concave surface of each of a plurality of lens blanks.

Another object of the invention is to provide a radially adjustable grinding wheel whose diameter may be varied to grind concave surfaces of constant radius to a relatively large number of different radii.

A further object of the invention is to provide a radially adjustable segmental diamond abrasive grinding wheel in which the abrasive bond is heat softenable material, displaceably by a truing roll and subject to attack by an alkali solution to aid in truing and dressing the abrasive surface of the wheel.

Other objects and features of the invention will become apparent from the following description taken in conjunction with the accompanying drawings.

BRIEF DESCRIPTION OF THE DRAWINGS

FIG. 1 is a plan view showing the arrangement of the various elements of the apparatus for grinding concave surfaces of a plurality of lens blanks according to the invention;

FIG. 2 is a partial right-hand side view of the apparatus of FIG. 1, showing drive means for rotating the grinding wheel at both a grinding speed and a truing speed;

FIG. 3 is a left-hand end view of the apparatus of FIG. 1 showing the grinding wheel, the truing roll and the work holder in cross section;

FIG. 4 is an enlarged side view of a radially adjustable segmental grinding wheel for grinding concave surfaces to various degrees of curvature and radii on the lens blanks;

FIG. 5 is a sectional view through a wheel mounting and the grinding wheel mounted thereon showing the construction of one embodiment of the wheel and the means for varying the diameter of the wheel.

FIG. 6 is a partial sectional view showing the construction of another embodiment of the radially adjustable grinding wheel and means for varying the radius and diameter thereof; and FIG. 7 is a partial sectional view showing the construction of still another embodiment of the radially adjustable grinding wheel and means for varying the radius and diameter thereof.

DESCRIPTION OF THE PREFERRED EMBODIMENT(S)

In the accompanying drawings there is shown a lens grinding apparatus 10 for carrying out the principles of the Applicant's invention. The lens grinding apparatus 10 comprises a wheel slide base or base 12 having a conventional vee way 12*a* and a flat way 12*b* and supports a conventional wheel feed screw 14 fixed to a hand wheel 16 rotatable relative to the wheel slide base 12.

Slideably mounted on the wheel slide base 12 is a wheel slide or support 20 having conventional complementary mating slideways (not shown) in supporting and guiding engagement with the ways 12*a* and 12*b*. A conventional feed nut 20*a* is fixed to the wheel slide 20 and engages the feed screw 14 for moving the wheel slide 20 relative to the base 12.

Mounted on the wheel slide 20 are drive means for selectively driving a grinding wheel at either a relatively high grinding speed or lower truing speed comprising an adjustable wheel drive motor base 22 slideably mounted on the wheel slide base 20. A belt adjusting screw 24 engages a feed nut (not shown) fixed to the motor base 22. A high grinding speed wheel drive motor M is fixedly mounted on and movable with the motor base 22 relative to the wheel slide upon rotating the belt adjusting screw 24. A drive pully 26 is fixed to the output drive shaft of the wheel drive motor M and connected by drive belts 28 to a driven pulley 30 fixed to one end of a rotatable wheel spindle 32 rotatably journaled in suitable conventional bearings within a spindle housing 20*c* in the forward portion of the wheel slide or wheel support 20.

The low truing speed or auxilliary drive means may comprise a conventional motor driven gear reduction unit RM of the type commercially available from Boston Gear Works, Quincy, Massachusetts. A drive gear 34 is slideably keyed to the output drive shaft of the reduction unit RM and has an annular recess into which extends the shifting fork of a gear shift rod or shaft 36 slideably mounted on the housing of the gear reduction unit for shifting the gear 34 into and out of driving engagement with a wheel spindle drive gear 38 fixed to the wheel spindle 32 adjacent the pully 30.

Wheel mounting means for supporting, varying the diameter of, and attaching a radially adjustable grinding wheel to the opposite end of the wheel drive spindle 32 are provided comprising a wheel mounting arbor or spindle 40 having a short threaded end portion 40*a* threaded into a threaded hole and an adjacent tapered portion 40*b* in mating engagement with a tapered bore 32*a* within the opposite end of the wheel drive spindle 32. There is a flange 40*c* adapted to fit a spanner wrench adjacent the large end of the tapered portion and a relatively long threaded portion 40*d* with a keyway 40*c* extending from the flange 40*c* through an arbor hole in the grinding wheel to the opposite end of the mounting arbor 40. Wheel adjusting means are provided comprising a pair of adjustable wheel flanges or spanner nuts 42 and a locknut or flange 43 threaded onto the portion 40*d* and located at opposite sides of a radially adjustable grinding wheel 50. Alternatively, the wheel mounting arbor 40 could be an integral part of the spindle but is preferably a separate arbor attached to and removable together with the grinding wheel from the spindle 40 by applying the proper wrench to flange 40*c* and turning it in the proper direction. Also, instead of a threaded arbor the wheel mounting could comprise a threaded wheel bushing extending through the arbor hole in the wheel 50 and on which the flanges 42 are carried for direct mounting on a suitable wheel drive spindle.

Referring to FIGS. 4 to 7, the radially and diametrically adjustable grinding wheel 50 has a wheel support center 52 comprising either a single or a pair of substantially identical flexible, slotted deformable walls or wall portions 52*a* of substantially identical shape or curvature of greater radial length than the initial minimum radius to which the wheel support center 52 is made. Preferably each wall of the center 52 has a plurality of angularly spaced deformable wall portions 52*a* about a central or hub portion 52*b* which may include an annular boss or washer 52*c* formed integrally with or suitably fixed to the inner side of the hub portions encircling anxially aligned arbor holes 52*d* and a key 52*e* for mounting on and keying the wheel to the arbor 40. A plurality of angularly spaced radial slots 52*f* extend radially outward from the central hub portion to peripheral surface portions 52*d* of the center 52 and the wheel 50.

In one embodiment shown in FIG. 5 a pair of deformable side walls are axially spaced from one another about the center or arbor hole 52*d* from which they extend radially outward in inwardly converging curved paths to narrow arcuate shape segmented peripheral mounting portions 52*g* of the side walls of the wheel center 52. Preferably the segmented peripheral mounting portions of the side walls are fixed together by welding, but may be fastened together by riveting, bolting and any other suitable conventional method of fastening.

The walls are preferably made of relatively thin sheet metal selected from a group consisting of steel, brass, aluminum and allows thereof which, after being formed to the desired initial minimum diameter and curvature, either provide or can be further treated to provide deformable resilient and flexible spring metal walls. Hence, the side walls can be moved axially toward each other to straighten or decrease the shape or curvature and increase the diameter and, thereafter, allowed to move further apart by releasing the resilient force to increase the shape or curvature and decrease the diameter of the wheel.

A plurality of bonded abrasive segments 54 of substantially uniform radial and axial thickness are fixedly mounted onto the narrow segmented peripheral portions 52*g*, between the slots 52*f*, of the support center 52. Each abrasive segment 54 has an arcuate shape and contains a plurality of abrasive particles of desired grit or mesh size bonded together by bonding material. The bond material is preferably an electrically conductive metal bond heat softenable at temperatures above that generated during grinding of the lens blanks and subject to attack by an alkali solution used to dress the abrasive surface of the segments 54. The abrasive particles are preferably natural or synthetic diamonds or diamonds coated with a thin layer or alkali insoluble metal such as iron, nickel, copper, chromium, tungsten and alloys thereof.

Preferably the bond material may be one of a number of suitable super plastic alloys of metals selected from a group consisting of zinc, aluminum, cadmium and alloys thereof. One example of which is a metal alloy comprising 78 percent by weight of zinc and 22 percent by weight of aluminum. The zinc-aluminum alloy begins to soften at approximately 370° C. and is readily attacked by an alkali solution such as potassium and sodium hydroxide.

Each abrasive segment 54 may be made and attached to the center 52 in any suitable conventional manner well known in the art. One method of making and attaching the abrasive segment is to first make an abrasive bond mixture comprising 15 to 30 percent by weight of nickel-coated diamond particles of 80 to 220 grit size mixed with 70 to 85 percent by weight of a bonding alloy in powder form containing 78 percent by weight of zinc and 22 percent by weight of aluminum. The abrasive bond mixture is placed in a mold, pressed and sintered to the desired form. The arcuate abrasive segments are then placed and fixed, as by soldering, to the peripheral segment portions of the center in the well-known manner. Upon completion the abrasive peripheral surface of the wheel is trued and dressed to be concentric with its axis of rotation.

Referring to FIGS. 4 and 5, each grinding wheel 50 has an initial minimum diameter and radius which can be increased to a greater maximum diameter and radius shown in phantom lines by straightening out and moving the curved thin flexible and resilient deformable wall portions 52*a* to single parallel planes as shown in phantom lines at 52*h*. Hence, the grinding wheel can be expanded or contracted varying amounts within an adjustable range between its minimum and maximum diameter by varying the shape of the deformable walls and wall portions 52*a* angularly spaced around the hub portion 52*b*.

It can be seen that loosening the locknut 43 and moving each of the flanges or spanner nuts 42 equal amounts toward or away from each other causes the deformable wall portions 52*d* to move axially equal distances relative to the portion 40*d* of mounting arbor 40 without changing the axial position of the abrasive segments 54 relative to a grinding plane GP shown in FIG. 1. The lens grinding wheel 50 may be made to any desired initial diameter, and have any number of slots and abrasive segments therebetween with an axial thickness preferably between ⅛ to 1 inch. The side walls may have a thickness of 1/32 to ¼ of an inch which is determined by the initial diameter of the grinding wheel desired. For example, a wheel approximatey 10 inches in diameter has less mass and therefore thinner side walls than one of greater diameter and mass. Also, the deformable side wall portions 52*a* may be formed to other various curvatures and shapes. For example, each wall may have a corrugated shape, as shown in FIGS. 6 and 7, comprising any number of concave valleys between pairs of engaging convex ridges of any desired degree of curvature. Preferably the shape or degree of curvature is such that when the deformable wall portions 52*a* are compressed together, they will straighten out and increase the radius of the wheel at least ¼ of an inch and hence its diameter ½ of an inch. Hence, one wheel can be adjusted to grind an infinite number of concave surfaces of different radii falling within the expansible or adjustable range of the wheel that are concentric with the axis of the wheel.

The embodiments of the grinding wheel 50 shown in FIGS. 5, 6 and 7 have generally the same circular and slotted configuration shown in FIG. 4 and differ from one another in the number of walls, spacing of the walls, the size and configuration of the deformable portions 52*a* of the walls in the center 52. In FIG. 6 the center 52 has a pair of contacting walls each with corrugated shaped deformable wall portions 52*a* in contact with relatively large wheel adjusting flanges 42 threaded on the mounting arbor 40.

As shown in FIG. 7 the grinding wheel 50 has a center 52 comprising a single wall with a plurality of corrugated shaped deformable wall portions 52 engaged by a large flange 42 threaded on the arbor 40. In addition, there are a pair of large annular nuts 44 threaded on the flanges 42 to straighten and maintain the outer peripheral wall portions of the center and the abrasive segments attached thereto in a central position normal to the axis of the rotation of the wheel as shown.

To adjust the wheel 50, the annular nuts 44 are first loosened relative to the flanges 42 to disengage them from opposite sides of the center 52. Locknut 43 is then loosened and flanges 42 turned and moved relative to the arbor 40 equal amounts toward or away from each other to change the shape of the deformable wall portion 52 until the desired diameter and radius of the wheel is attained. During the adjustment the outer peripheral wall portions of the center 52 and abrasive segments 54 may be tilted slightly at an angle relative to a plane normal to the axis of wheel rotation. After tightening the locknut 43, the annular nuts 44 are adjusted relative to the flanges 42 to engage, shift and lock the realigned outer peripheral wall portion and the abrasive segments thereon in the desired central position shown.

Means are provided for truing and dressing the grinding wheel comprising a truing slide 60 slideably mounted in a dovetail slideway 20*d* on the wheel side of the wheel support or slide 20. An electrically conductive, freely rotatable truing roll 62, preferably made of tungsten carbide, is mounted on and electrically insulated from a truing roll support spindle 64 fixed to the slide 60. The truing roll has a center bushing 63 or core made of electrically insulating ceramic material fixed thereto and a peripheral truing face of the desired coutour for engaging the peripheral abrasive surface of the wheel 50. Truing roll feed means are provided including a rotatable feed screw 66 fixed against axial movement relative to the wheel slide 20 but rotatably engaging a conventional feed nut (not shown) fixed to the slide 60 and a hand wheel 68 fixed to the end of the feed screw 66.

Rotation of the hand wheel 68 and screw 66 moves the slide 60 and the truing roll 62 relative to the wheel slide 20 and the peripheral abrasive face of the grinding wheel 50 mounted thereon.

Electrical resistance heating means are provided for conducting and passing an electrical current for heating and softening the abrasive bond in peripheral abrasive surface of the wheel 50 so that it can be displaced and trued to the proper radius by forcing the roll 62 into engagement therewith. The heating means comprises an electrical circuit which is completed by closing a main switch S1 in line L1, a contact C2 of a selector switch S2 connected by a conduit to a slip ring or brush 69 held resiliently in contact with the side of the electrically conducting truing roll 62. When the truing roll contacts the abrasive surface of the slowly rotated wheel 50, electrical current passes through the junction or area of contact and the electrically conducting wheel 50, through spindles 40 and 32, and a slip ring or brush 70 held resiliently in contact with the rotating end portion of spindle 32 to line L2.

Simultaneously, with the closing of contacts C2, the selector switch S2 is interlocked to open a contact C1 and close contacts C2 and C3. Opening C1 de-energizes the high speed grinding wheel drive motor M, and closing of C2 and C3 makes current available to simultaneously heat the wheel as described above and energize the low truing speed reduction drive motor unit RM. Operator then operates fork shift rod 36 and shifts drive gear 34 into driving engagement with the wheel spindle drive gear 38 which rotates the spindles 32, arbor 40, and the grinding wheel 50 at a relatively slow truing speed which is preferably under 10 revolutions per minute (RPM). The freely rotatable truing roll 62 is then forced into engagement with and frictionally driven by the wheel 50 at the same surface feet per minute while the abrasive bond is heated and softened and the roll 62 trues the wheel to the desired radius. Obviously the desired radius is determined by the final infeed position of the engaging truing roll face from the rotational axis of the grinding wheel 50.

In practice the wheel 50 is first either expanded or contracted to a diameter and radius which is a few thousandths of an inch greater than the final desired secondary radius which is then produced by feeding the truing roll into engagement with the grinding wheel.

Following truing the truing roll 62 is retracted and the trued surface with displaced bonding material covering the abrasive particles is dressed by applying, in any conventional manner, an alkali solution thereto. For example, an alkali solution of sodium hydroxide may be topically applied by painting with a brush until sufficient bonding material is removed to merely expose the coated or uncoated abrasive particles after which the solution remaining on the wheel is neutralized by flooding with water.

After dressing the wheel 50 is ready to grind a concave surface on lens blanks to the curvature of the dressed wheel. Operator declutches and disengages gear 34 from gear 38 and actuates selector switch S2 to open contacts C2 and C3 which opens truing circuits and stops the slow truing speed drive unit RM and closes contacts C1 to energize high speed grinding wheel drive motor M.

Radially adjustable work holding means are provided to hold and either rotate or oscillate a plurality of lens blanks in a first plane HP, at right angle to the grinding plane GP, and at a predetermined radius R1 about a primary axis, pivot or center P1, situated at the intersection of the planes HP and GP, across the grinding face of the wheel 50 rotating about an axis on the first plane HP. Hence the wheel 50 simultaneously grinds, on the lens blanks, concave surfaces having both a constant primary radius R1 and a constant, secondary radius R2 situated at right angles to one another. As an example, a typical concave surface of a lens blank ground may have a primary radius R1 of 20 inches and relatively smaller secondary radius of 5 inches.

As shown in FIGS. 1 and 3, the work holding means may be of either arcuate or circular shape as indicated by the phantom lines extending between the ends of the arcuate shape shown in solid lines.

Preferably the work holding means 80 is of semicircular or arcuate shape and comprises an arcuate shaped work holder base 80 of predetermined radius and arcuate length, fixed relative to the wheel slide base 12 of the grinding unit. The base 82 has an arcuately shaped guideway 82*a* extending to opposite ends situated at substantially equal angular distances from the grinding plane GP which passes through the primary or vertical axis, pivot or center P1, through the grinding wheel 50 parallel to and between the sides of the abrasive segments 54 and at right angles to the axis of rotation of the grinding wheel 50.

Slideably mounted and held in the guideway 82*a* is a mating work holding slide 84 which extends upwardly to a top surface on which are a plurality of angularly spaced, horizontal radially extending dovetail type slideways 84*a* and bores 84*b*, extending radially below and parallel to the sideways 84*a*.

A removable work slide retainer or member 86, fixed with bolts to the base 82, slideably engages a machined surface on and holds the slide 84 down against the guideway 82*a* to prevent vertical movement thereof.

A plurality of radially adjustable lens carrier support brackets or slides 88, with horizontal mating dovetail slideway portions 88*a*, are slideably mounted on the angularly spaced mating slideways 84*a* on the slide 84. Each of the carrier support slides 88 is of substantially L-shape in cross section, and has a vertical leg or side portion 88*b* extending upwardly from one side of the shorter horizontal leg, bottom of slideway portion 88*a*. Fixed to and extending downwardly from the opposite side of the bottom or slide portion 88*c* is a nut 90 into which is threaded a work holder or work support bracket adjusting screw 92. The adjusting screw 92 has one end portion rotatably mounted in the bores 84*b* and fixed against axial radial movement relative to the slide 84 and a threaded portion extending radially therefrom to a polygonal shaped portion adapted to fit a suitable wrench or crank for turning the screw 92.

Each of the vertical side portions 88*b* extend upwardly beyond the horizontal plane HP passing through the pivot P1 and the axis of rotation of the grinding wheel 50 and have, adjacent the top, a recess or notch 88*d* with recessed and shouldered locating surfaces against which is fixed by screws or bolts a lens blank carrier 94 of predetermined radius. The lens blank carrier 94 is of arcuate shape and supported by the angularly spaced brackets 88 situated between and adjacent the ends of the carrier 94. On the inner concave side of the carrier 94 is a channel or recess 94*a* with locating surfaces to which a plurality of lens blanks L to be ground are fixed in the conventional manner.

Preferably the lens blanks L are precisely mounted on and adhesively fixed to a carrier having a locating surface of a radius either equal to or relatively close to and parallel to the radius of the outer mating convex surface of the lens blanks to be ground.

Lens blank carriers 94 of various radial dimensions can be mounted on and fixed to the support brackets 88 by merely turning the adjusting screws 92 in the proper direction until the brackets are in the proper radial position to receive a carrier of different radius. Obviously, the amount of radial movement of the brackets 88 between a predetermined minimum primary radius and a maximum primary radius from the pivot or center P1, limits the size and radius of the carrier which can be mounted thereon to a range of sizes falling between the predetermined minimum and maximum primary radii from the pivot or center P1 about which the carrier 94 moves.

Work drive means are provided for moving the work holder slide 84 together with the support brackets 88 and the carrier 94 lens blanks L thereon about the primary pivot or center P1, relative to the work holder base 82 and the grinding wheel 50. The work drive means comprises a driven gear segment or rack fixed to outer periphery of the work holder slide 84 and having gear teeth 84*c* meshing with a drive pinion gear 102 fixed to the output shaft of a reversible drive motor M3 fixed to the work holder support base 82. The drive motor M3 is energized by closing a switch S3 completing a circuit between L1 and L2 through contacts of a reversing switch RS connected to the motor M3. A pair of angularly spaced adjustable reversing dogs 104 and 106 are fixed to and movable with the work holder slide 84 relative to the contact actuating lever 108 of the reversing switch RS fixed to the work holder base 82.

As schematically shown in FIG. 1, the position of the lever 108 connects L1 to a first set of contacts of the reversing switch RS to a conduit CC for driving the motor M3 and the pinion 102 clockwise. Clockwise rotation of pinion 102 drives the work holder slide 84 and lens blanks L counterclockwise until the dog 106 actuates and shifts lever 108 on reversing switch RS counterclockwise out of contact with the first set of contacts and into contact with a second set of contacts connected to a conduit C for driving the motor M3 and the pinion 102 in the opposite counterclockwise direction. Rotation of the pinion 102 counterclockwise drives the work holder slide 84 and lens blanks L clockwise until dog 104 actuates and shifts lever 108 of reversing switch RS clockwise to position shown, which repeats the cycle just described until the switch S3 is opened.

Alternatively, the motor for driving the work holder slide 84 may be a conventional rotary hydraulic or pneumatic fluid pressure driven reversible motor controlled respectively by a hydraulic or pneumatic rotary directional control valve or other suitable reversing valves actuated by the dogs in the manner described above. Obviously, when the work holder 80 is of circular shape, the reversible motor M3 and reversing switch RS and dogs 104 and 106 are not required and the slide 84 can be continuously rotated in either direction by a conventional drive motor.

Prior to performing a grinding operation, the lens blanks are mounted on a lens carrier of the proper radial size which when fixed to the work holder support brackets 88 positions the unground concave surfaces of the lens blanks at a radius, from the primary pivot or center P1, less than the desired primary radius of curvature R1 to which they are to be ground. The grinding wheel 50 is radially adjusted, trued and dressed in the manner described above to produce the desired secondary radius of curvature R2 at right angles to the primary radius of curvature R1.

The operator then closes switch S1 starting grinding wheel 50 which is retracted to a starting position away from that shown in FIGS. 1 and 3. Switch S3 is then closed starting motor M3 and the lens blanks L oscillating about the primary or vertical pivot, axis or center P1. Operator then intermittently feeds the narrow periphery abrasive surface of the grinding wheel 50 by intermittently rotating the hand wheel 16 and feed screw 14 at the end of each pass of the entire group of lens blanks across the grinding wheel 50. Grinding continues until the primary curvature of the concave surface is ground to the desired primary radius R1, after which the grinding wheel is retracted to the starting position, the switch S3 opened to stop oscillation of the lens carrier and the lens carrier with ground lens blanks L thereon removed from the work holder support brackets 88.

The concave surfaces of the lens blanks ground by apparatus of the invention will have simultaneously ground primary or secondary curvatures each of constant uniform radius, situated at right angles to one another. In most instances, the radius of the first or primary curvature is greater than the radius of the second or secondary curvature produced by the grinding wheel 50.

As many modifications and changes may be made in the embodiments described above without departing from the spirit of the invention, it is to be understood that the embodiments described and illustrated are for illustrative purposes only and the invention includes all modifications falling within the scope of the appended claims.

What is claimed is:

1. A radially adjustable grinding wheel for grinding concave surfaces to constant radii comprising:

a circular slotted support center of predetermined initial minimum diameter and radius from its axis of rotation having at least one relatively thin deformable, integral, circular, sloted wall, a hub portion about the axis of rotation, a plurality of radial slots angularly spaced around and extending radially outward from the hub portion to angularly spaced narrow peripheral surface portions of greater length than axial thickness extending between the radial slots, and a plurality of relatively thin deformable wall portions of predetermined shape between the angularly spaced radial slots and having a length greater than the initial minimum radius when measured in a single radial plane along the wall portions between the peripheral surface portions and the axis of rotation and which upon being deformed varies the diameter and radius of the support center and grinding wheel;

a plurality of angularly spaced bonded abrasive segments fixed to the peripheral surface portions of the support center; and wheel mounting means, in the hub portion of the center, for attaching the grinding wheel to a wheel drive spindle for rotation about the axis of rotation, deforming the wall portions to vary the diameter and radius of the wheel and maintaining the center and the grinding wheel fixed against axial movement and at a predetermined constant radius and diameter during grinding of the concave surfaces.

2. A radially adjustable grinding wheel according to claim 1 wherein the wheel mounting means comprises;

a wheel mounting arbor extending coaxially through an arbor hole in the hub portion;

attaching means on the wheel mounting arbor for attaching the arbor to the wheel drive spindle; and wheel adjusting means on the wheel mounting arbor for varying the shape of the deformable wall portions, the diameter and radius of the wheel.

3. A radially adjustable grinding wheel according to claim 2 wherein the wheel adjusting means comprises:

a threaded portion on the wheel mounting arbor extending axially through the arbor hole in the hub portion;

a pair of spaced flanges on the threaded portion in clamping engagement with opposite sides of the support center and movable axially relative to each other to clamp the center therebetween and to vary the shape of the deformable wall portions, the diameter and radius of the support center and grinding wheel.

4. A radially adjustable grinding wheel for grinding concave surfaces to constant radii comprising:

a support center of predetermined initial minimum diameter and radius from its axis of rotation having a pair of axially aligned, relatively thin, slotted, side walls fixed together at angularly spaced peripheral surface portions of the support center and each side wall having a hub portion about the axis of rotation, a plurality of aligned radial slots angularly spaced around and extending radially outward from the hub portion to the angularly spaced peripheral surface portions between the radial slots, and a plurality of relatively thin deformable wall portions of predetermined shape between the angularly spaced radial slots and having a length greater than the initial minimum radius when measured in a single radial plane along the wall portions between the peripheral surface portions and the axis of rotation and which upon being deformed varies the diameter and radius of the support center and grinding wheel;

a plurality of angularly spaced bonded abrasive segments fixed to the peripheral surface portions of the support center;

a wheel mounting arbor in the hub portion of the center having a threaded portion extending coaxially through an arbor hole in each hub portion;

a pair of spaced flanges on the threaded portion of the arbor in clamping engagement with opposite sides of the support center and movable axially relative to each other to clamp the center therebetween and to vary the shape of the deformable wall portions, the diameter and radius of the support center and grinding wheel; and attaching means on the arbor for attaching the arbor and grinding wheel to a wheel drive spindle for rotation about the axis of rotation.

5. A radially adjustable grinding wheel according to claim 4 wherein the side walls of the support center are made of relatively thin flexible and resilient sheet metal selected from a group consisting of steel, brass, aluminum, and alloys thereof.

6. A radially adjustable grinding wheel according to claim 5 wherein the abrasive segments comprise:

diamond abrasive particles coated with an alkali insoluble metal selected from a group consisting of nickel, iron, copper, chromium, tungsten and alloys thereof; and an alkali soluble, electrically conductive metal bond bonding the abrasive particles together selected from a group consisting of zinc, aluminum, cadmium and alloys thereof.

7. A grinding wheel comprising:

diamond abrasive grits coated with an alkali insoluble metal and bonded in a metal matrix wherein the metal is an alloy of alkali soluble metals selected from a group consisting of zinc, aluminum and cadmium whereby a grinding surface of the wheel can be trued and formed to a desired size and shape by the application of heat and pressure thereto sufficient to cause plastic flow of the metal matrix and dressed by the application of aqueous alkali to the grinding surface to expose a portion of the insoluble metal coated abrasive grits.

* * * * *